US007767113B2

(12) United States Patent
Kobayashi

(10) Patent No.: US 7,767,113 B2
(45) Date of Patent: Aug. 3, 2010

(54) METHOD OF MANUFACTURING METAL-GRAPHITE BRUSH MATERIAL FOR MOTOR

(75) Inventor: Hiroshi Kobayashi, Kariya (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 216 days.

(21) Appl. No.: 12/279,244

(22) PCT Filed: Feb. 24, 2006

(86) PCT No.: PCT/JP2006/303459

§ 371 (c)(1),
(2), (4) Date: Aug. 13, 2008

(87) PCT Pub. No.: WO2007/096989

PCT Pub. Date: Aug. 30, 2007

(65) Prior Publication Data

US 2009/0060772 A1 Mar. 5, 2009

(51) Int. Cl.

| | |
|---|---|
| ***H01B 1/22*** | (2006.01) |
| ***H01B 1/06*** | (2006.01) |
| ***H01B 1/24*** | (2006.01) |
| ***C22C 29/00*** | (2006.01) |
| ***C22C 5/00*** | (2006.01) |
| ***B22F 9/00*** | (2006.01) |

(52) U.S. Cl. ..... 252/503; 75/243; 75/247; 252/506; 252/511

(58) Field of Classification Search ..... 252/503; 75/243, 247
See application file for complete search history.

(56) References Cited

U.S. PATENT DOCUMENTS

| | | | | |
|---|---|---|---|---|
| 2004/0255720 | A1* | 12/2004 | Kobayashi | 75/243 |
| 2009/0060772 | A1* | 3/2009 | Kobayashi | 419/11 |

FOREIGN PATENT DOCUMENTS

| | | |
|---|---|---|
| JP | 2001 298913 | 10/2001 |
| JP | 2003 313076 | 11/2003 |
| JP | 2004 164926 | 6/2004 |
| JP | 2005 12957 | 1/2005 |

* cited by examiner

*Primary Examiner*—Mark Kopec
*Assistant Examiner*—Jaison P Thomas
(74) *Attorney, Agent, or Firm*—Oblon, Spivak, McClelland, Maier & Neustadt, L.L.P.

(57) ABSTRACT

A method of manufacturing a metal-graphite brush material for a motor, which allows high-density formation of copper particles on the surfaces of graphite particles. The method: attaches copper complex to graphite particles; heat-treats the graphite particles attached with the copper particles, thereby to pyrolyze the copper complex to form copper particles on the surfaces of the graphite particles; forms the graphite particles having the copper particles formed thereon, together with a resin, into a formed product; and reduction-sinters the formed product under a reducing atmosphere to pyrolyze the resin, thereby to form a sintered body and also to reduce copper oxide formed in surface layers of the copper particles during the heat-treating.

8 Claims, 2 Drawing Sheets

METHOD OF MANUFACTURING METAL-GRAPHITE BRUSH MATERIAL FOR MOTOR

TECHNICAL FIELD

The present invention relates to a method of manufacturing metal-graphite brush material for a motor.

BACKGROUND ART

Conventionally, as a brush material for use in a brushed motor, there is known a metal-graphite brush material for motor, manufactured by mixing graphite particles and copper particles together with using a binder solvent and then sintering the resultant mixture (see Patent Document 1).

According to one example of such method of manufacturing a metal-graphite brush material for motor, the method comprises: kneading particles of natural graphite with using a phenol resin solution as a binder; granulating the resultant material into a predetermined shape; mixing the resultant graphite particles with an amount of copper powder according to a density of current to be supplied to the brush, and with a required amount of solid lubricant; forming the resultant mixture into a predetermined shape; and sintering the resultant formed product under a non-oxidizing atmosphere, with blocking oxygen. With such manufacturing method, the phenol resin formed as a coating on the surfaces of the graphite particles is carbonized into non-crystalline carbon, thereby binding the graphite particles together. And, in the course of the reduction-sintering step, oxygen atoms and hydrogen atoms constituting the phenol resin dissolved solution are sublimed as carbon dioxide or steam, a number of pores will be formed on the surface and in the interior of the sintered product.

In general, with a motor using a metal-graphite brush, as the metal-graphite brush comes into sliding contact with the commutator, electricity is supplied from the brush to the commutator or from the commutator to the brush. And, to the commutator, there is connected a coil wound about a core provided in the rotor. In response to supply of electricity to the coil, the rotor is driven to rotate by a force of attraction or repulsion generated in cooperation with a permanent magnet disposed within a housing in opposition to the rotor.

The metal-graphite brushed motor, as being operated according to the above-described operational principle, suffers the problem of wear-out of the metal-graphite brush at its surface sliding against the commutator, due to the sliding contact between the metal-graphite brush and the commutator during driving of the motor. To restrict such wear-out of the metal-graphite brush during motor driving, various researches have been conducted so far.

As one example of such technique as above, there is a technique which takes note of the fact that the wear of the metal-graphite brush is attributable not only to the mechanical wear due to its sliding contact with the commutator, but also to electric load from spark discharge. Then, the technique proposes a metal-graphite brush material having a group of mutually contacting copper particles supported on the surfaces of the graphite particles (see, e.g. Patent Document 2). With this metal-graphite brush material, conductive paths for conducting electric charge induced from the graphite particles are formed on the surfaces of the graphite particles, so that spark discharge can be restricted, and the wear due to the spark charge too can be restricted. Further, with this metal-graphite brush material, as copper is formed into fine particles, it is possible to reduce the amount of charge discharged form the copper fine particles, thereby restricting the electric energy of the spark discharge and restricting also the level of electric noise generated during spark discharge.

According to a method of manufacturing such metal-graphite brush material described above, first, solution of copper complex is applied to the surfaces of the graphite particles to form a coating on the surfaces of the graphite particles. Then, these graphite particles are kneaded with a resin solution as a binder. The resultant graphite particle mixture is formed into a formed product. This formed product is then subjected to a sintering step under an oxygen-containing atmosphere and then a heat treatment under a reducing atmosphere. With this, copper particles are formed on the surfaces of the graphite particles and at the same time the graphite particles can be bonded together with the powder having a low molecular weight formed as the result of pyrolysis of the resin.

Patent Document 1: Japanese Patent Application "Kokai" No. 2001-298913

Patent Document 2: Japanese Patent Application "Kokai" No. 2005-12957

DISCLOSURE OF THE INVENTION

Object to be Achieved by the Invention

However, in the case of manufacturing such metal-graphite brush material having a group of mutually contacting copper particles supported on the surfaces of the graphite particles, with the conventional method of manufacturing metal-graphite brush material, there is a problem of low molecular pyrolyzed resin power being formed also, on the surfaces of the graphite particles, together with the copper particles, during the sintering step. For this reason, the density of the copper particles formed on the graphite particle surfaces tends to be low, thus failing to effectively restrict spark discharge.

On the other hand, if it were not for the interposition of the low molecular powder of pyrolyzed resin, the mechanical strength of the metal-graphite brush material would be lower, which causes difficulty in the mechanical work for attaching a terminal, called pigtail, used in the metal-graphite brush.

The present invention has been made in view of the above-described problem. The object of the present invention is to provide a method of manufacturing a metal-graphite brush material for motor, which allows high-density formation of copper particles on the surfaces of graphite particles.

Means to Accomplish Object

For accomplishing the above-noted object, according to a first characterizing feature of a method of manufacturing a metal-graphite brush material for motor, relating to the present invention, the method comprises the steps of:

attaching copper complex to graphite particles;

heat-treating the graphite particles attached with the copper particles, thereby to pyrolyze the copper complex to form copper particles on the surfaces of the graphite particles;

forming the graphite particles having the copper particles formed thereon, together with a resin, into a formed product; and reduction-sintering said formed product under a reducing atmosphere to pyrolyze said resin, thereby to form a sintered body and also to reduce copper oxide formed in surface layers of the copper particles during said heat-treating step.

That is to say, according to the above solution, the step of forming copper particles on the graphite particles and the step of binding the graphite particles are provided separately from each other, so that after copper particles are formed in groups on the surfaces of the graphite particles, the graphite particles are sintered together with the resin. With this, the low molecular powder generated as the result of pyrolysis of the resin is formed on the outer side of the copper particle groups to bind the graphite particles. Hence, there occurs no interference to the formation of the copper particle groups. As a result, copper particles can be formed in a high density on the surfaces of the graphite particles.

Therefore, with the metal-graphite brush using the metal-graphite brush material for motor according to the present invention, the copper as the "core" of spark discharge is dispersed in the form of groups of particles, thereby reducing the electric energy of the spark discharge. Consequently, it is possible to reduce damage to the metal-graphite brush and damage to the commutator, thus reducing the wear-out amount. Further, with the possibility of reduction in the electric energy of the spark discharge, it is also possible to reduce the level of electric noise generated in the course of occurrence of spark discharge.

According to a second characterizing feature of the inventive method of manufacturing metal-graphite brush material for motor, said reduction-sintering step employs a sintering temperature which is set lower than a heat-treating temperature employed in said heat-treating step.

Namely, with this solution, by setting the sintering temperature employed in the reduction-sintering step lower than the heat-treating temperature employed in the heat-treating step, it is possible to prevent the copper particles formed on the surfaces of the graphite particles in the heat-treating step from growing further to become coarse particles in the reduction-sintering step. Therefore, the fine particles of copper can be formed in high density on the surfaces of the graphite particles.

According to a third characterizing feature of the inventive method of manufacturing a metal-graphite brush material for motor, a sintering temperature employed in the reduction-sintering step and a heat-treating temperature employed in the heat-treating step are both set to range from 300 to 350° C.

Namely, with this solution, by setting the sintering temperature employed in the reduction-sintering step and the heat-treating temperature employed in the heat-treatment to range from 300 to 350° C., it is possible to restrict further growth of the copper particles, thus allowing formation of fine copper particles in high density on the surfaces of the graphite particles.

According to a fourth characterizing feature of the inventive method of manufacturing a metal-graphite brush material for motor, said reduction-sintering step employs a sintering temperature which is higher than a pyrolysis-starting temperature of the resin.

Namely, with this solution, in the reduction-sintering step, the resin is pyrolyzed into the low molecular powder and this pyrolyzed resin binds the graphite particles together. Therefore, it is possible to manufacture a metal-graphite brush material for motor having a high bending strength.

According to a fifth characterizing feature of the inventive method of manufacturing a metal-graphite brush material for motor, said resin is prepared in the form of a solution containing from 1 to 3 wt. % of solids of the resin dissolved therein.

Namely, by using the resin in the form of a solution containing from 1 to 3 wt. % of solids of the resin dissolved therein, there is provided a preferred embodiment of the method of manufacturing a metal-graphite brush material for motor, which allows formation of copper particles in high density.

According to a sixth characterizing feature of the inventive method of manufacturing a metal-graphite brush material for motor, said resin is at least one kind of resin selected from the group consisting of a phenol resin and a fran resin That is, according to this solution, by using, as the resin, at least one kind of resin selected from the group consisting of a phenol resin and a fran resin, there is provided a preferred embodiment of the method of manufacturing a metal-graphite brush material for motor, which allows formation of copper particles in high density.

According to a seventh characterizing feature of the inventive method of manufacturing a metal-graphite brush material for motor, said phenol resin comprises a resol-type melamine modified phenol resin.

That is, according to this solution, by using a resol-type melamine modified phenol resin as the phenol resin, there is provided a preferred embodiment of the method of manufacturing a metal-graphite brush material for motor, which allows formation of copper particles in high density.

According to an eighth characterizing feature of the inventive method of manufacturing a metal-graphite brush material for motor, said reduction-sintering step employs a sintering period which is set to 200 minutes or more, in the case of a sintering temperature ranging from 300 to 350° C.

That is to say, by effecting the reduction-sintering under the above-described conditions, it is possible to provide the resin with thermal stability, so that adhesive wear when used as a metal-graphite brush can be avoided.

BEST MODE OF EMBODYING THE INVENTION

According to a method of manufacturing a metal-graphite brush material for a motor relating to the present invention, the method comprises the steps of:

attaching copper complex to graphite particles;

heat-treating the graphite particles attached with the copper complex, thereby to pyrolyze the copper complex to form copper particles on the surfaces of the graphite particles;

forming the graphite particles having the copper particles formed thereon, together with a resin, into a formed product; and reduction-sintering said formed product under a reducing atmosphere to pyrolyze said resin, thereby to form a sintered body and also to reduce copper oxide formed in surface layers of the copper particles during said heat-treating step.

That is to say, according to the above method, the step of forming copper particles on the graphite particles and the step of binding the graphite particles are provided separately from each other, so that after copper particles are formed in groups on the surfaces of the graphite particles, the graphite particles are sintered together with the resin. With this, the low molecular powder generated as the result of pyrolysis of the resin is formed on the outer side of the copper particle groups and chemically bound with the graphite particles and the copper particles, thereby binding the graphite particles together either directly or indirectly via the copper particles. Hence, the generation of the low molecular powder resulting from the pyrolysis of the resin causes no interference to the formation of the copper particle groups. As a result, copper particles can be formed in a high density on the surfaces of the graphite particles.

In general, since the number of contact points between the mutually sliding contact faces of the metal-graphite brush and the commutator is extremely small, most of the sliding contact faces thereof are atmosphere-mediated. With this, most of the sliding faces are formed as small gaps of atmosphere.

Then, if an electric potential is applied to the metal-graphite brush, there is induced a high electric field, which excites Π electrons constituting the valence electrons of the graphite particles. The excited Π electrons will simultaneously move to the copper particles which are present in close vicinity to the graphite particles and which are in a state of relative low potential. As the copper particles are unable to store these moved Π electrons, the Π electrons will be discharged at once. This phenomenon is a spark discharge phenomenon. And, with this spark discharge phenomenon, there occurs local sublimation of the copper particles equivalent to the "core" of the spark discharge, which results in destruction within the brush. Some spark discharge can even reach the commutator. Then, the spark reached the commutator causes local sublimation of the surface of the commutator, resulting in a change in the surface condition thereof, which leads, in turn, to abrasive wear of the metal-graphite brush.

Then, with the metal-graphite brush using the metal-graphite brush material according to the present invention, as copper particles are formed in high density on the metal-graphite brush material, the number of Π electrons generated from the graphite particles to be accumulated on the copper particles is reduced as being dispersed according to the sizes and number of the copper particles. With this phenomenon, there occurs reduction in the energy of the spark discharge from one copper particle. With this, damage to the metal-graphite brush and damage to the commutator are reduced, so that the wear amount of the metal-graphite brush can be reduced. Further, with the possibility of reduction in the energy of spark discharge, the electric noise accompanied with spark discharge too can be reduced, according to the size and number of copper particles. This eliminates the need for taking some measure against electric noise accompanied with spark discharge.

The metal-graphite brush material for motor, as illustrated in FIG. 1, can be manufactured through an attaching step S1, a heat-treating step S2, a forming step S3, and a reduction-sintering step S4. Next, these respective steps of the inventive method of manufacturing a metal-graphite brush material for motor will be described in details.

(Attaching Step)

The attaching step is a step for attaching copper complex to graphite particles. For instance, this attachment is possible by placing a solution of copper complex in contact with the graphite particles. In placing the copper complex solution in contact with the graphite particles, the method used therefor is not particularly limited, but any conventional known method such as submersion, application, spraying, etc., can be employed.

The copper complex to be attached to the graphite particles is not particularly limited. It is preferred, however, to employ e.g. a copper carboxylate complex, which can be readily synthesized and which can be readily dissolved in an organic solvent and which also can be pyrolyzed at a relatively low temperature. Copper carboxylate complex can be prepared through a liquid phase reaction between a copper compound and a carboxylic acid. Some non-limiting examples of the copper compound include copper chloride, copper sulfate, copper carbonate, etc. Some non-limiting examples of the carboxylic acid include a linear saturated monocarboxylic acid such as butanoic acid, octanoic acid, a linear saturated dicarboxylic acid, a chain saturated monocarboxylic acid, a chain unsaturated monocarboxylic acid, a chain unsaturated monodicarboxylic acid, an aromatic carboxylic acid, etc. Among them, a copper linear saturated monocarboxylate complex using linear saturated mono-carboxylic acid as the carboxylic acid is particularly preferred. Copper linear saturated monocarboxylate complex exhibits a pyrolysis temperature of 150° C. or less, which is lower than those of other copper carboxylate complexes, so that in the heat-treating step, copper particles can be formed at a relatively low temperature ranging from 300 to 350° C. By employing copper linear saturated monocarboxylate complex as the copper complex as above, the pyrolysis is possible at a particularly low temperature among other copper carboxylate complexes. As a result, it is possible to carry out the heat treatment in the heat-treating step at such a temperature as allows restriction of growth to copper particles.

In case the copper complex is used in the form of a solution, as the solvent for dissolving the copper complex, it is possible to employ water, methanol, ethanol, 1-propanol, 1-butanol, etc. And, in this case, the solution can be caused to additionally contain e.g. a surfactant, for obtaining improved affinity with the graphite particles.

(Heat-Treating Step)

The heat-treating step is a step for heat-treating the graphite particles with the copper complex attached thereto, under an oxygen-containing atmosphere. With this step, the copper complex is pyrolyzed and copper particles are formed on the surfaces of the graphite particles. The oxygen-containing atmosphere can be atmospheric atmosphere, oxygen-rich atmosphere, oxygen atmosphere, etc. and this can be conveniently selected and not particularly limited.

In this heat-treating step, the copper complex attached to the surfaces of the graphite particles are pyrolyzed at 150° C. or lower, so that the copper atoms are separated. The separated copper atoms are then formed into copper molecules and with further increase in the temperature, these grow into copper particles. On the other hand, if the heat-treating temperature is too high, this will further promote growth of the copper particles, thus rendering them coarse, so that the on the surfaces of the graphite particles, the copper particles will be formed like scattered islands, thus reducing the forming density. In view of these, it is preferred that the heat-treating temperature be from 300 to 500° C. In particular, in order to restrict growth of the copper particles, thereby to allow formation of copper particles in high density on the surfaces of the graphite particles, it is preferred that the heat-treating step be carried out at 300 to 350° C., and the nearer 300° C., the better. With this, the Π electrons generated from the graphite particles to be accumulated on the copper particles will be effectively dispersed, thereby further reducing the number of Π electrons discharged from the copper particles. Hence, the energy in the spark discharge can be further restricted. Therefore, it is particularly preferred that the heat-treating step be carried out at 300° C. Further, the heat-treating period is not particularly limited. However, in case the heat-treating step is carried out at 300° C., the period of approximately 2 hours is preferred in order to allow sufficient growth into copper particles at 300° C.

Incidentally, in this heat-treating step, this step is carried out under an oxygen-containing atmosphere, in order to pyrolyze the copper complex. Accordingly, the copper particles formed on the surfaces of the graphite particles will be oxidized on their surfaces, so that copper oxide will be formed in the surface layers of the copper particles.

(Forming Step)

The forming step is a step in which the graphite particles with the copper particles formed thereon are formed together with a resin as a binder into a formed product. Any conventional method can be employed therefor. For instance, the resin may be used as a solution of the same dissolved in a solvent. Then, after attaching, by e.g. applying, the resin solution to the graphite particles with the copper particles formed on the surfaces thereof, these graphite particles will be charged into a box-like container, which will then be pressurized with a predetermined pressure (e.g. 100 Pa), whereby a formed compacted product of graphite particles can be formed.

The resin to be used as a binder is not particularly limited, but can be selected appropriately. It is preferred, however, to employ one which is pyrolyzed at a temperature lower than the heat-treating temperature employed in the heat-treating step. With this, in the reduction-sintering step, the graphite particles can be bonded together, either directly or indirectly via the copper particles, without affecting the copper particles formed already on the surfaces of the graphite particles. For instance, thermoplastic resins such as polyethylene resin, polypropylene resin, polystyrene resin, are not pyrolyzed under a reducing atmosphere at 300° C. or lower. Therefore, as the binder, a resin which can be pyrolyzed under a reducing atmosphere of 300° C. approximately, is preferred.

An example of such resins as above comprises at least one kind of thermoplastic resin selected from the group consisting of fran resins and phenol resins. In the case of a fran resin, approximately 55 wt. % of the resin will be pyrolyzed under a nitrogen atmosphere of 300° C., and 45 wt. % thereof will remain in the form of solid powder having a lower molecular weight. Incidentally, if such fran resin is employed as the binder, as will be shown in an example to follow, the bending strength of the metal-graphite brush material can be improved from e.g. 6.5 $N/mm^2$ to 12.5 $N/mm^2$, thus allowing a mechanical work thereof as a metal-graphite brush.

Further, in case a phenol resin is employed, in the case of a novolac-type phenol resin (PR-311 manufactured by SHUMITOTO BAKELITE Co., Ltd.), maximum of 26 wt. % of the resin will be pyrolyzed under an atmospheric atmosphere of 600° C., whereas approximately 8 wt. % thereof will be pyrolyzed under an atmospheric atmosphere of 300° C. and the pyrolyzing ratio will be even lower under a reducing atmosphere. For this reason, as the phenol resin, a modified phenol resin having further reduced heat resistance is preferably used.

The modified phenol resin is not particularly limited. Some non-limiting examples thereof include many modified phenol resins having enhanced properties of phenol resin, such as melamine modified phenol resin, epoxy modified phenol resin, cashew modified resin, cresol modified phenol resin, resorcin modified phenol resin, aromatic hydrocarbon resin modified phenol resin, oil modified phenol resin, terpene modified phenol resin, furan modified phenol resin, etc. For example, a resol type melamine modified phenol resin (PR-53728Y manufactured by SHUMITOTO BAKELITE Co., Ltd.), if heated at the rate of 10° C./min., exhibits a pyrolysis curve shown in FIG. 2, and maximum of 13 wt/% thereof will be pyrolyzed under an atmospheric atmosphere of 300° C.

Further, it is preferred that the resin to be used as the binder have thermal stability after the reduction-sintering step. That is to say, if the resin is thermally unstable, the temperature elevation due to the sliding contact between the metal-graphite brush and the commutator, will further promote pyrolysis of the resin at the sliding faces of the metal-graphite brush and the commutator, whereby there will occur adhesion of the resin to the sliding faces of the commutator and the brush, which can lead to adhesive wear of the metal-graphite brush.

In view of the above, as shown in FIG. 3, investigation of the relationship between the treating period and the pyrolysis ratio at 300° C. under the atmospheric atmosphere in the case of the resol-type melamine modified phenol resin shows that the pyrolysis progress gradually until 200 minutes, reaching a pyrolysis ratio of 26 wt. %, but the pyrolysis reaches saturated condition after 250 minutes, to progress no further. That is to say, in case the resol-type melamine modified phenol resin is employed, by extending the treatment period to promote the pyrolysis and to cause it to reach saturation, it is possible to stabilize it at that temperature. In this way, by causing the pyrolysis to progress to turn it into a substance which is thermally stable at 300° C., the metal-graphite brush will not reach 300° C. through its sliding contact with the commutator; hence, there will be no risk of adhesive wear of the metal-graphite brush at the sliding face during the driving of the motor. Incidentally, if such resol-type melamine modified phenol resin is employed as the binder, as will be shown in an example to follow, the bending strength of the metal-graphite brush material can be improved from e.g. 6.5 $N/mm^2$ to 13 $N/mm^2$.

The amount of the resin to be added as a binder in the forming step is not particularly limited. However, the addition amount should be within a range for restricting increase in the electric resistance, since the low molecular powder generated as the result of pyrolysis of the resin increases the electric resistance of the brush. For this reason, it is preferred that the amount thereof to be used as the binder be minimal as long as it can ensure the required bending strength of the metal-graphite brush material. For instance, if the resin is used in the form of its solution, it is preferred that this solution be one in which from 1 to 3 wt. % of the solid contents of the resin is dissolved in the solvent. Solution containing 2 wt. % of solids is more preferred. In case the resin is used in the form of its solution, the solvent for dissolving the resin can be methanol, ethanol, 1-propanol, 1-butanol, etc.

(Reduction-Sintering Step)

The reduction-sintering step is a step for sintering the formed product under a reducing atmosphere. With this step, a sintered body is formed and at the same time, the copper oxide formed on the surface layer of the copper particles during the heat-treating step is reduced to copper. The reducing atmosphere is not particularly limited. For example, it is possible to employ a mixture gas atmosphere containing from 50 to 95 vol % of nitrogen gas and from 5 to 50 vol. % of hydrogen gas. A reducing atmosphere comprised of 90 vol. % of nitrogen gas and 10 vol. % of hydrogen gas is particularly preferred, from the viewpoints of the effect of reducing copper oxide into copper and safety of the reducing operation. The reduction-sintering step can be carried out at 150 to 500° C. approximately. In order to restrict growth, in this step, of the copper particles which have been formed already on the surfaces of the graphite particles, it is preferred that the sintering temperature be set lower than the heat-treating temperature employed in the above-described heat-treating step. On the other hand, it is preferred that the sintering temperature be set higher than the pyrolysis starting temperature of the resin as the binder. From these viewpoints, it is preferred that the reduction-sintering be carried out at 300 to 350° C., more preferably, near 300° C. Further, the heat-treating period should range, preferably from 10 minutes to 5 hours approximately. For example, if the above-described resol-type melamine modified phenol resin is employed as the binder, by carrying out the reduction-sintering for 200 minutes or more at 300 to 350° C., the pyrolyzed powder will become thermally stable, so that if this is used as the metal-graphite brush, it is possible to avoid adhesive wear of the metal-graphite brush at its sliding face relative to the commutator.

Next, the present invention will be described in greater details by way of some examples of the method of manufacturing a metal-graphite brush material for motor. It should be understood, however, that the present invention is not to be limited to these examples.

EXAMPLE 1

Copper octanoate was dissolved in 1-butanol solution to a concentration near the saturated solution. To this, a non-ionic surfactant comprised of hydrophilic polyoxyethylene alkyl ether was added at 2 vol. % and stirred for 10 minutes. In this solution, natural graphite particles were submerged and the particles were stirred therein for about 30 minutes, so as to attach the solution evenly to the surfaces of the natural graphite particles. Thereafter, the natural graphite particles were removed from the solution and the particles were heated under an atmospheric atmosphere from the room temperature to 150° C. at the rate of 5° C./min and then maintained therein at 150° C. for one hour. After this, the particles were heated to 300° C. at the rate of 5° C./min and then maintained therein at 300° C. for five hours., thereby to form groups of copper particles on the surfaces of the natural graphite particles.

Next, as a binder, a resol-type melamine modified phenol resin was employed and this was dissolved in methanol to the solid content of 2 wt. %. And, the resultant solution was applied by spraying over the natural graphite particles with the copper particles formed on the surfaces thereof. Thereafter, these graphite particles were charged into a mold to be formed into a shape of a brush, to which a forming operation was effected by applying a load of 50 tons hydraulically, thereby to obtain a formed product. Then, this formed product was subjected to a reduction-sintering for 250 minutes under a reducing atmosphere consisting of 90 vol. % of nitrogen gas and 10 vol. % of hydrogen gas, whereby a metal-graphite brush material for a motor having copper particles formed thereon in high density was obtained.

EXAMPLE 2

Fran resin was employed as a binder and a solution comprised of 5 wt. % of solid contents of the resin dissolved in methanol was employed. Except these, the same method as Example 1 above was employed to manufacture a metal-graphite brush material for motor.

Electric resistance values of the metal-graphite brush materials for motor manufactured in the respective examples above were determined by the four-point probe method. Further, bending strengths thereof were determined by supporting each metal-graphite brush material for motor at two lower points thereof and applying a pressure to one point at the center of the upper portion thereof. And, as a comparison example, similar determinations were made on a metal-graphite brush material for motor manufactured by mixing natural graphite particles with 45 wt. % of electric field copper power by the conventional manufacturing method. As a result, as shown in Table 1 below, it was confirmed that the metal-graphite brush material for motor manufactured by the manufacturing method of the present invention provides a smaller electric resistance than the conventional metal-graphite brush material for motor, yet has a substantially equal bending strength to the latter.

TABLE 1

| | electric resistance (Ω · cm) | bending strength ($N/mm^2$) |
|---|---|---|
| Example 1 | 1.2 E · 3 | 13.0 |
| Example 2 | 1.5 E · 3 | 12.5 |
| Comparison Example | 9.0 E · 3 | 13.7 |

Further, the metal-graphite brush materials manufactured in the respective examples and the comparison example were attached respectively to motors and the amounts of the wear and the electric noise levels of the metal-graphite brush materials were determined. The metal-graphite brush material was formed into the dimensions of 4.5 mm×9.0 mm, the load of the metal-graphite brush relative to the commutator was set as 78.5 kPa and the motor was rotated at the speed of 3.6 m/s, a current of 10 A was caused to flow between the metal-graphite brush and the commutator to rotate the motor. After its continuous rotation of 500 hours at the ambient temperature of 100° C., the electric noise level was determined, relative to a reference value 1 of the metal-graphite brush material manufactured in the comparison example. As a result, as shown in Table 2 below, it was found that in either example, there was a significant reduction both in the wear amount and in the electric noise, as compared with the comparison example.

TABLE 2

| | wear amount after 500 hours (mm) | noise level (dB) |
|---|---|---|
| Example 1 | 0.2 | −26 |
| Example 2 | 0.2 | −23 |
| Comparison Example | 2.5 | 1 |

As described above, it was confirmed that with the metal-graphite brush using the metal-graphite brush material manufactured by the manufacturing method according to the present invention, fine copper particles are formed in high density on the surface thereof, thus achieving the combined effect of restriction of spark discharge in the sliding contact and restriction of the electric noise.

INDUSTRIAL APPLICABILITY

The metal-graphite brush material manufactured by the manufacturing method according to the present invention can be applied to a metal-graphite brush for use in e.g. a motor for driving a water pump for cooling a vehicle engine, a motor for driving a cooling fan, a motor for driving an oil pump of the engine, etc.

Figure 1:
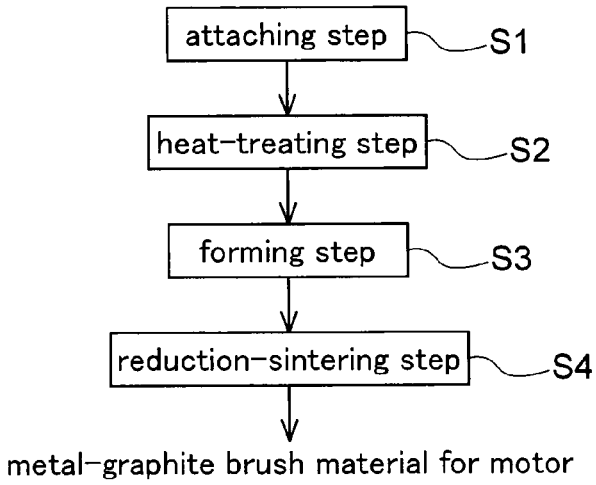
[FIG. 1] is a view illustrating a manufacturing process of a metal-graphite brush material for a motor.
Figure 2:
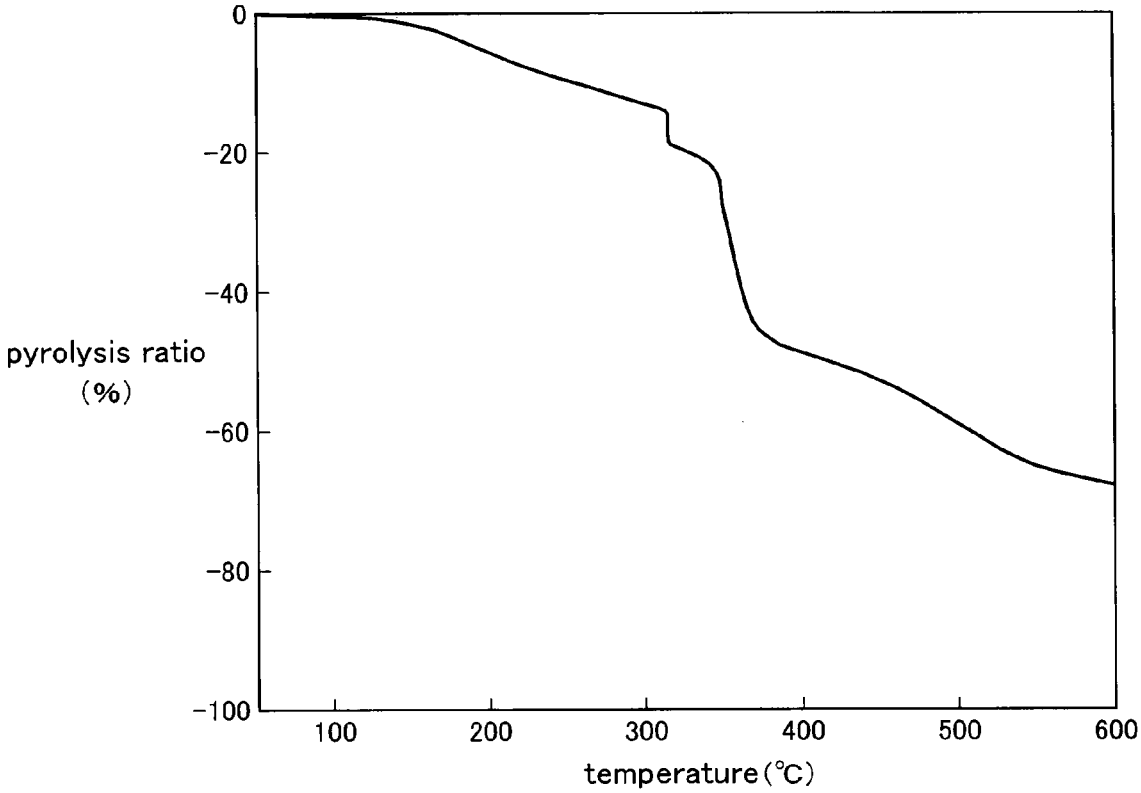
[FIG. 2] is a graph showing relationship between temperatures and pyrolysis ratios of a resol-type melamine modified phenol resin.
Figure 3:
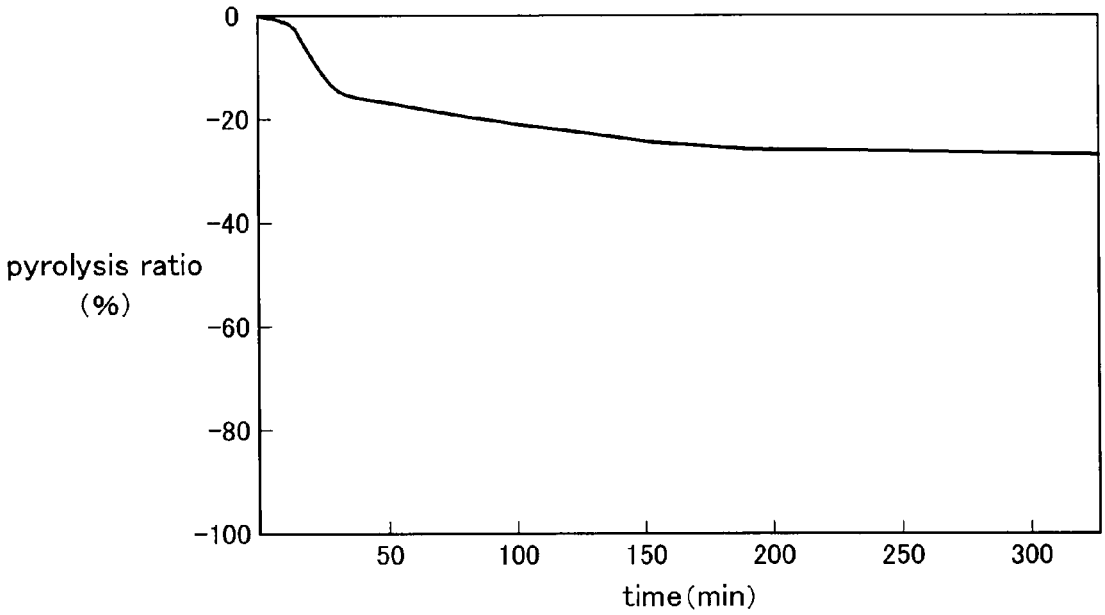
[FIG. 3] is a graph showing relationship between the time and pyrolysis ratios of the resol-type melamine modified phenol resin at 300° C.

The invention claimed is:

1. A method of manufacturing a metal-graphite brush material for motor, the method comprising the steps of:

attaching copper complex to graphite particles;

heat-treating the graphite particles attached with the copper particles, thereby to pyrolyze the copper complex to form copper particles on the surfaces of the graphite particles;

forming the graphite particles having the copper particles formed thereon, together with a resin, into a formed product; and reduction-sintering said formed product under a reducing atmosphere to pyrolyze said resin, thereby to form a sintered body and also to reduce copper oxide formed in surface layers of the copper particles during said heat-treating step.

2. The method of manufacturing a metal-graphite brush material for motor, according to claim 1, wherein said reduction-sintering step employs a sintering temperature which is set lower than a heat-treating temperature employed in said heat-treating step.

3. The method of manufacturing a metal-graphite brush material for motor, according to claim 1, wherein a sintering temperature employed in the reduction-sintering step and a heat-treating temperature employed in the heat-treating step are both set to range from 300 to 350° C.

4. The method of manufacturing a metal-graphite brush material for motor, according to claim 1, wherein said reduction-sintering step employs a sintering temperature which is higher than a pyrolysis-starting temperature of the resin.

5. The method of manufacturing a metal-graphite brush material for motor, according to claim 1, wherein said resin is prepared in the form of a solution containing from 1 to 3 wt.% of solids of the resin dissolved therein.

6. The method of manufacturing a metal-graphite brush material for motor, according to claim 1, wherein said resin is at least one kind of resin selected from the group consisting of a phenol resin and a fran resin.

7. The method of manufacturing a metal-graphite brush material for motor, according to claim 6, wherein said phenol resin comprises a resol-type melamine modified phenol resin.

8. The method of manufacturing a metal-graphite brush material for motor, according to claim 7, wherein said reduction-sintering step employs a sintering period which is set to 200 minutes or more, in the case of a sintering temperature ranging from 300 to 350° C.

* * * * *